US012137728B2

(12) United States Patent
Partouche

(10) Patent No.: US 12,137,728 B2
(45) Date of Patent: Nov. 12, 2024

(54) CARDBOARD FILTER FOR CIGARETTES, CIGARETTE AND MANUFACTURING METHOD THEREOF

(71) Applicant: Republic Technologies (NA) LLC, Glenview, IL (US)

(72) Inventor: Olivier Partouche, Barcelona (ES)

(73) Assignee: Republic Technologies (NA) LLC, Glenview, IL (US)

( * ) Notice: Subject to any disclaimer, the term of this patent is extended or adjusted under 35 U.S.C. 154(b) by 785 days.

(21) Appl. No.: 16/800,138

(22) Filed: Feb. 25, 2020

(65) Prior Publication Data

US 2020/0268043 A1 Aug. 27, 2020

(30) Foreign Application Priority Data

Feb. 25, 2019 (FR) ..... 1901882

(51) Int. Cl.

| | |
|---|---|
| ***A24D 3/04*** | (2006.01) |
| ***A24D 3/02*** | (2006.01) |
| ***A24D 3/10*** | (2006.01) |
| *A24D 1/04* | (2006.01) |

(52) U.S. Cl.

CPC ..... *A24D 3/04* (2013.01); *A24D 3/0245* (2013.01); *A24D 3/10* (2013.01); *A24D 1/045* (2013.01)

(58) Field of Classification Search

CPC ..... A24D 3/0245; A24D 5/465

See application file for complete search history.

(56) References Cited

U.S. PATENT DOCUMENTS

| | | | | |
|---|---|---|---|---|
| 1,183,339 | A * | 5/1916 | Brinton | A24D 1/042 131/361 |
| 2,001,709 | A * | 5/1935 | Davidson | A24D 3/0245 156/227 |
| 2,998,819 | A * | 9/1961 | Snowden, Jr. | A24D 3/04 131/194 |
| 3,370,594 | A * | 2/1968 | Haslam | A24D 3/045 131/210 |
| 4,582,071 | A | 4/1986 | Westcott et al. | |
| 10,412,990 | B2 * | 9/2019 | Sinclair, Jr. | A24C 1/26 |

(Continued)

FOREIGN PATENT DOCUMENTS

| | | | |
|---|---|---|---|
| CN | 205358202 | U | 7/2016 |
| FR | 2496416 | A1 | 6/1982 |

(Continued)

OTHER PUBLICATIONS

Blewonska, Jan, "Machine translation of WO 2020/083657," Translated Aug. 18, 2023, Clarivate Analytics (Year: 2023).*

(Continued)

*Primary Examiner* — Philip Y Louie
*Assistant Examiner* — Sonny V Nguyen
(74) *Attorney, Agent, or Firm* — Lerner David LLP

(57) ABSTRACT

The invention relates to a cardboard filter (1) for cigarettes, formed by folding, winding and gluing a cardboard strip (2). According to the invention, the cardboard strip (2) is folded to form a central portion (21) having a series of lobes (3, 4, 5, 6, 7) angularly equally distributed around a central axis (22) of the filter (2) and a peripheral portion (23) surrounding the central portion (21), the lobes (3, 4, 5, 6, 7) and the peripheral portion (23) delimiting gas passage channels (24) around the central axis (22).

10 Claims, 11 Drawing Sheets

(56) References Cited

U.S. PATENT DOCUMENTS

| | | | | |
|---|---|---|---|---|
| 2014/0202479 | A1 | 7/2014 | Nicholls et al. | |
| 2016/0128379 | A1 | 5/2016 | Jesperson et al. | |
| 2018/0271144 | A1 * | 9/2018 | Patel | A24D 3/10 |

FOREIGN PATENT DOCUMENTS

| | | | | |
|---|---|---|---|---|
| FR | 3057441 | A1 | 4/2018 | |
| GB | 2340375 | A | 2/2000 | |
| WO | 2014064726 | A1 | 5/2014 | |
| WO | WO-2020083657 | A1 * | 4/2020 | |
| WO | WO-2021019184 | A1 * | 2/2021 | A24C 5/465 |
| WO | WO-2021083543 | A1 * | 5/2021 | A24D 3/04 |

OTHER PUBLICATIONS

Knizhnik, Irina, "Partial Translation of CN 205358202 U," Translated Mar. 20, 2024, USPTO Translations Service Center. (Year: 2024).*

French Search Report for Application FR1901882 dated Nov. 14, 2019, 2 pages.

* cited by examiner

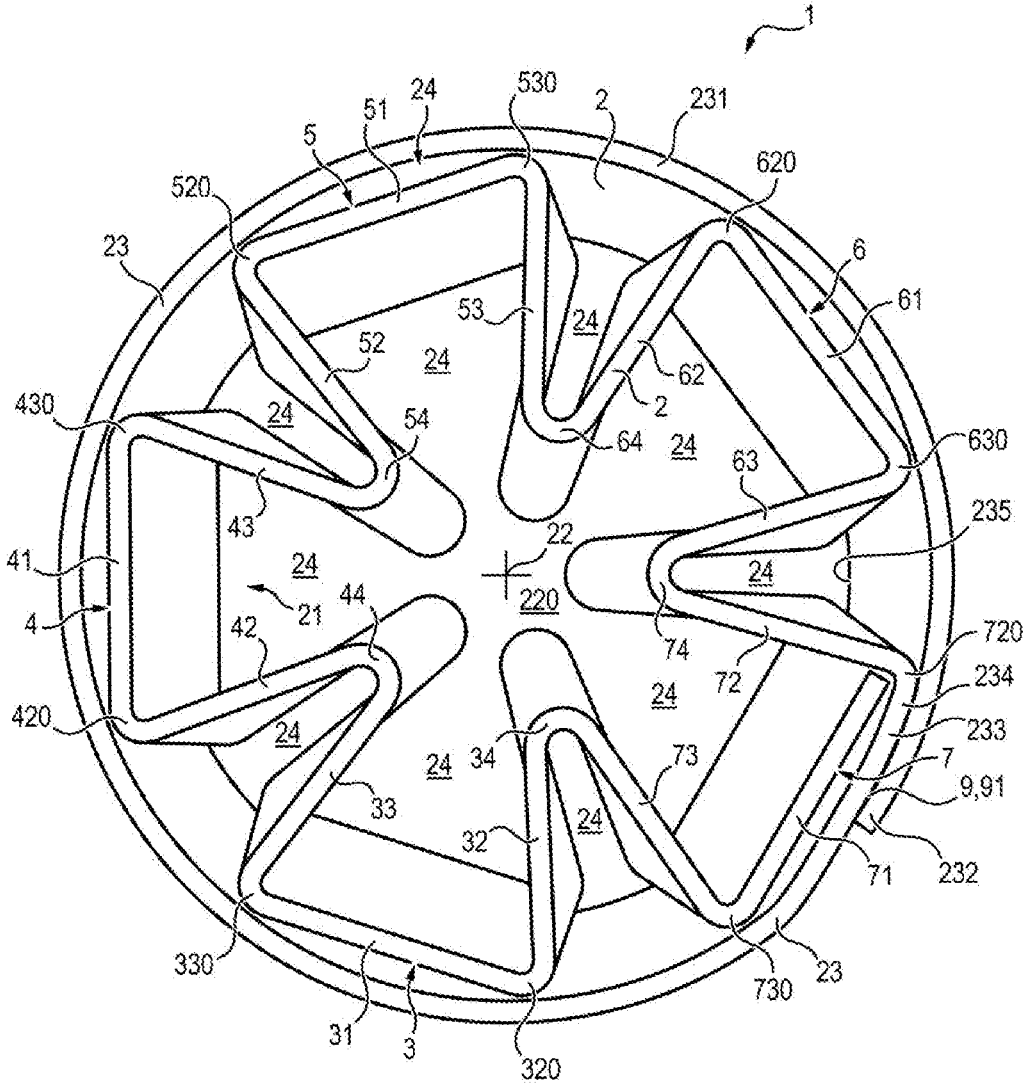
[Fig. 1]

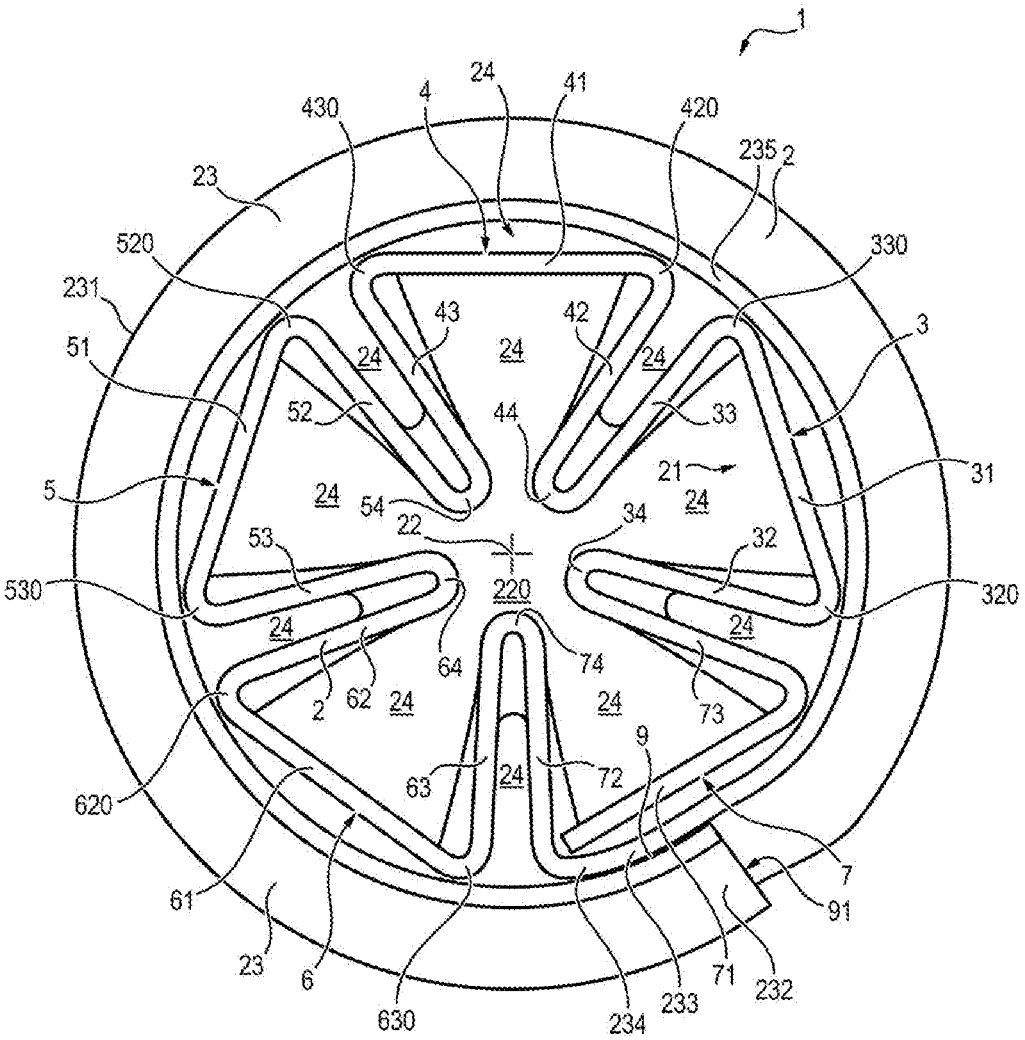
[Fig. 2]

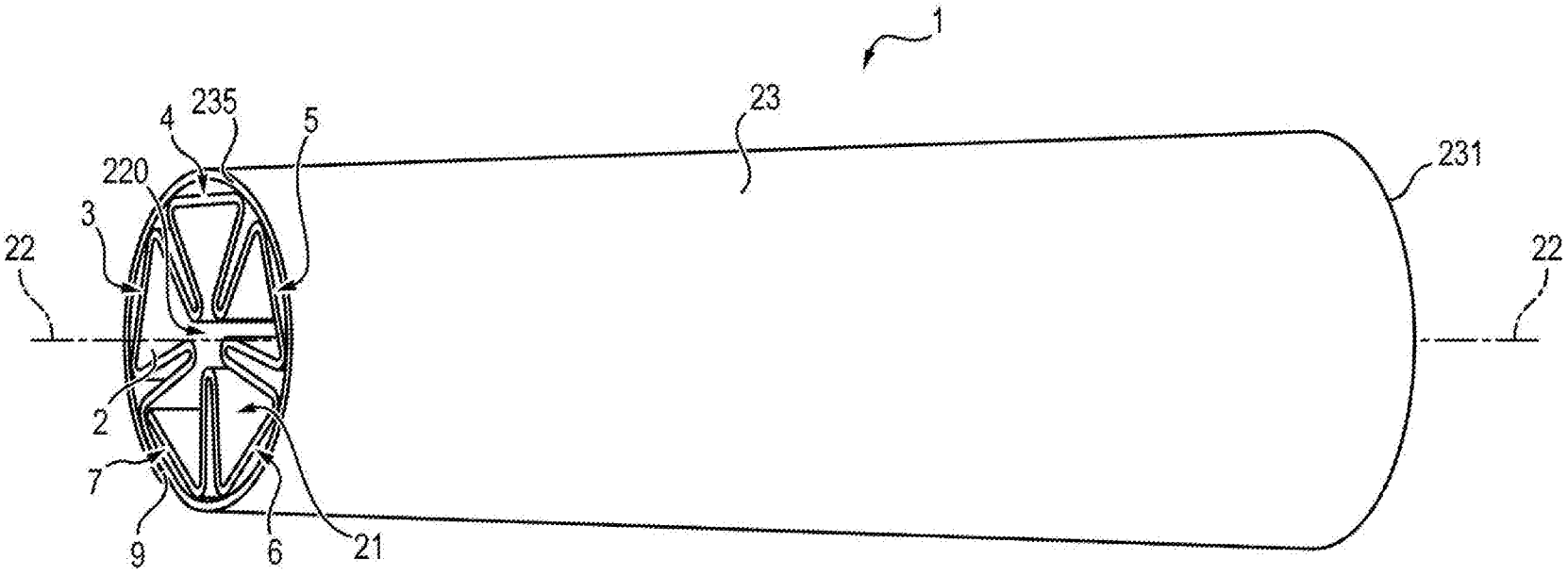
[Fig. 3]

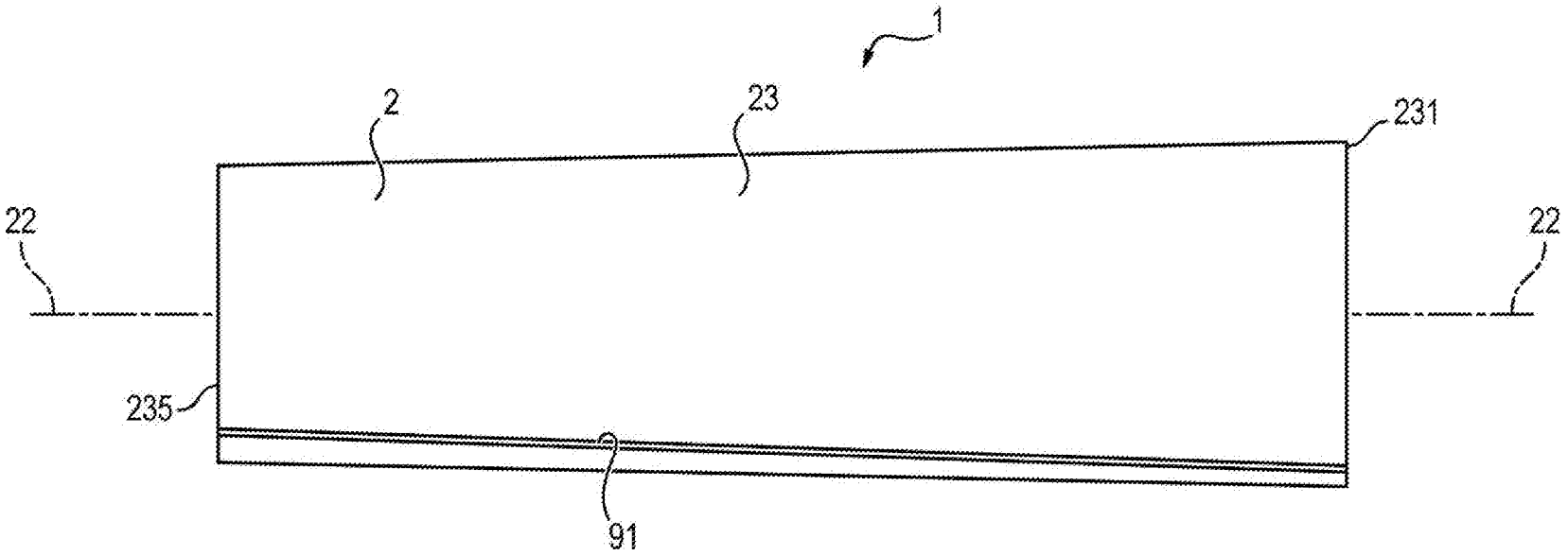
[Fig. 4]

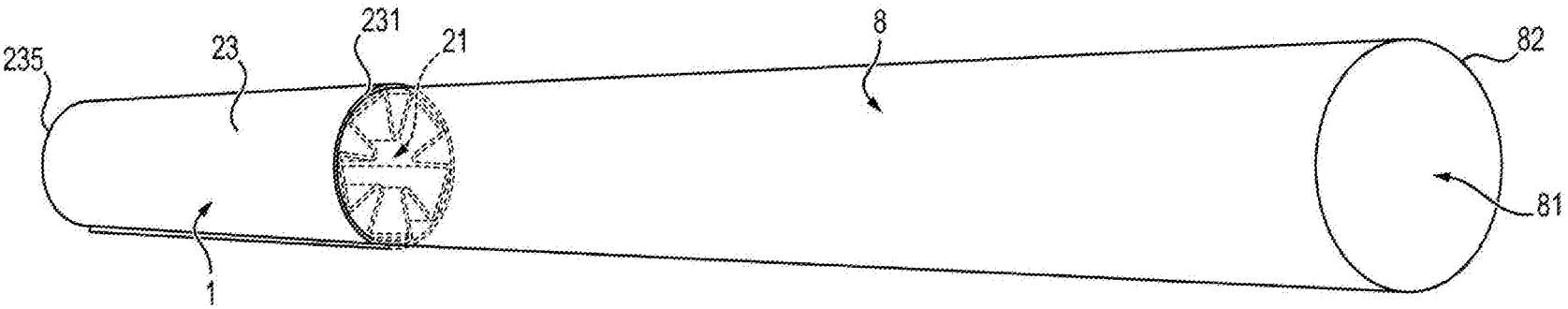
[Fig. 5]

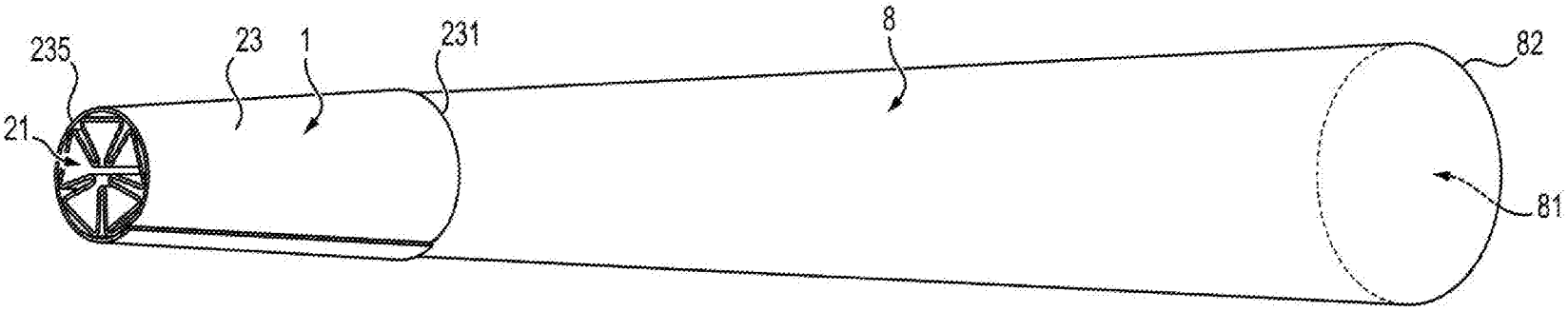
[Fig. 6]

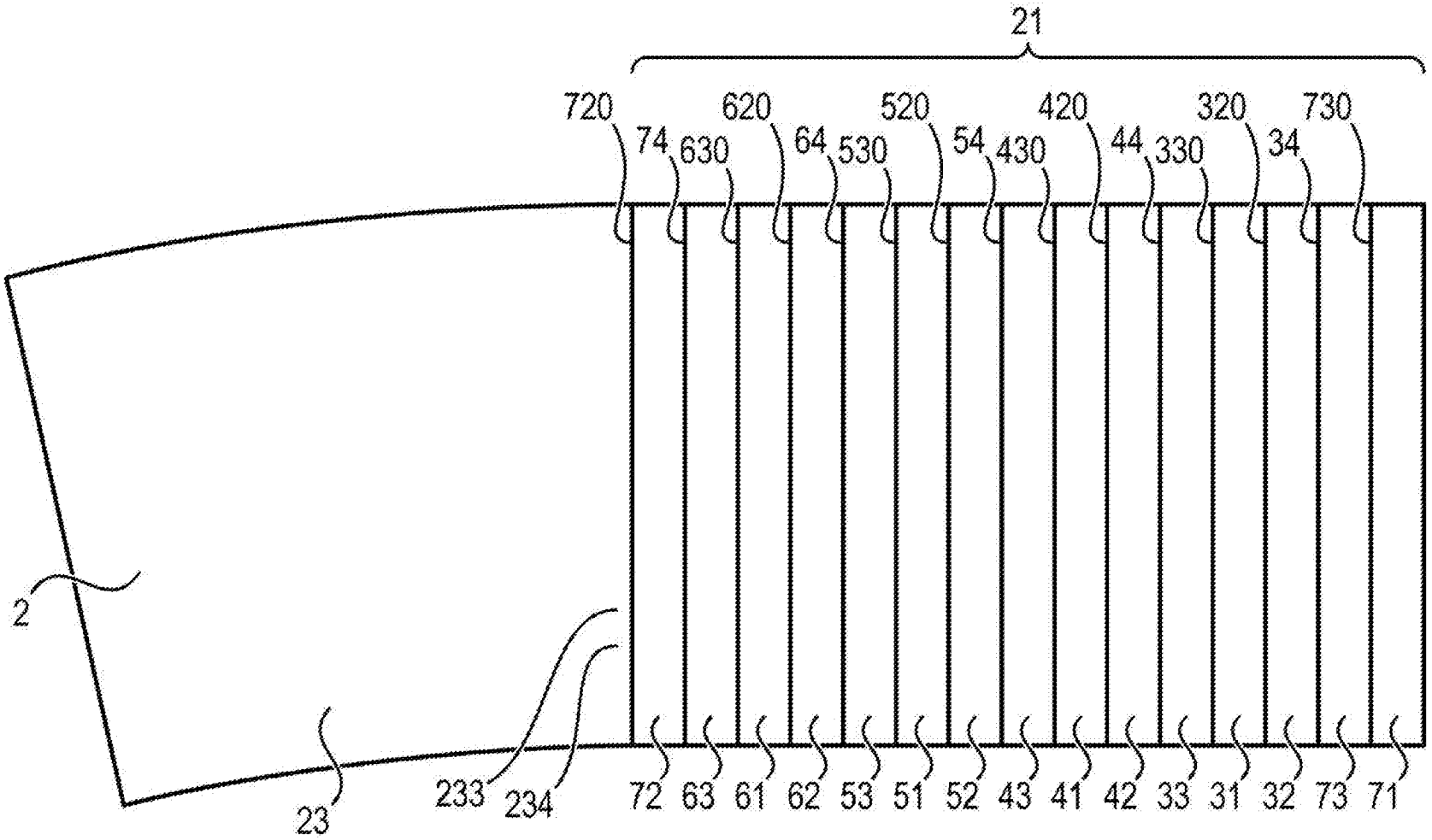
[Fig.7]

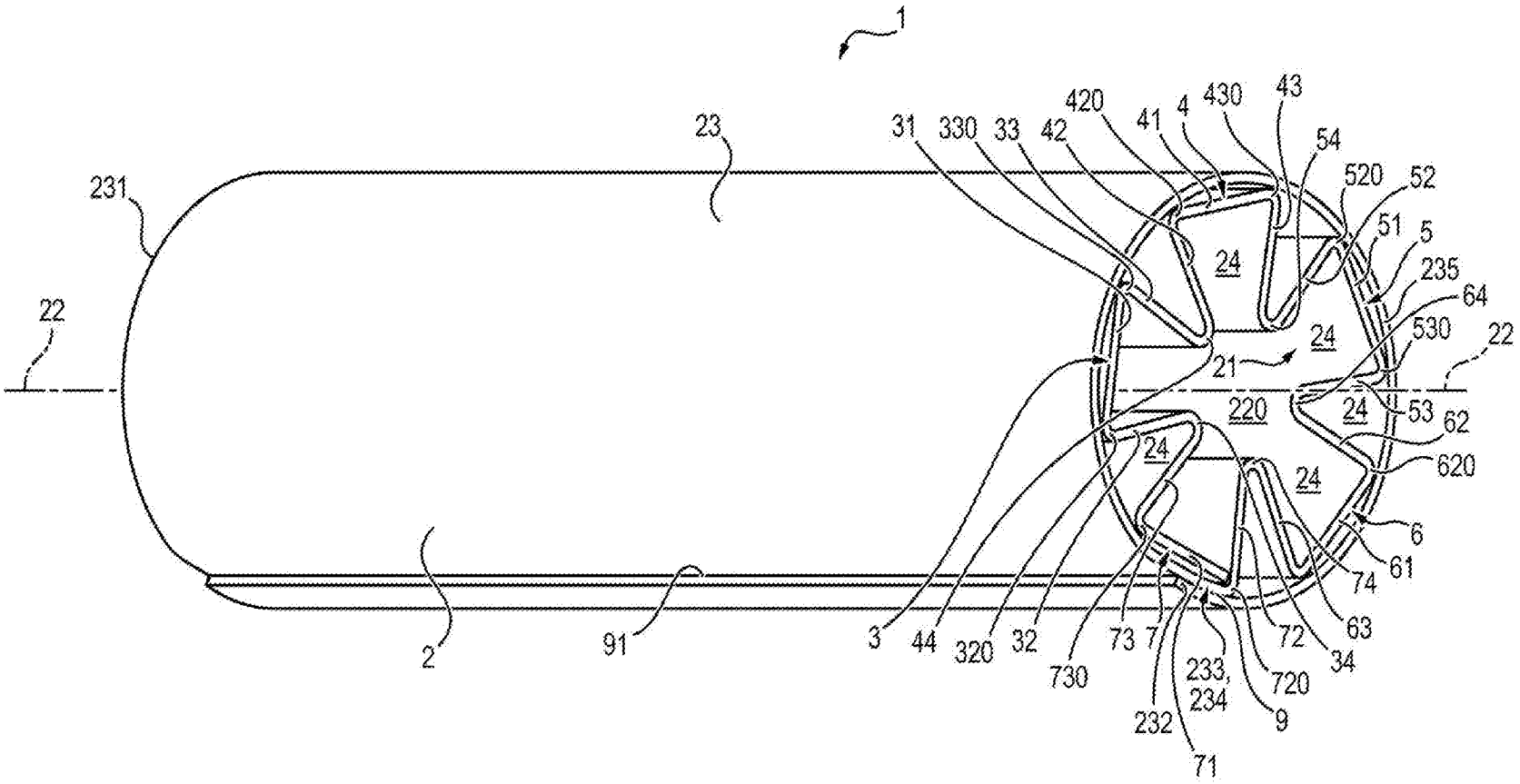
[Fig. 8]

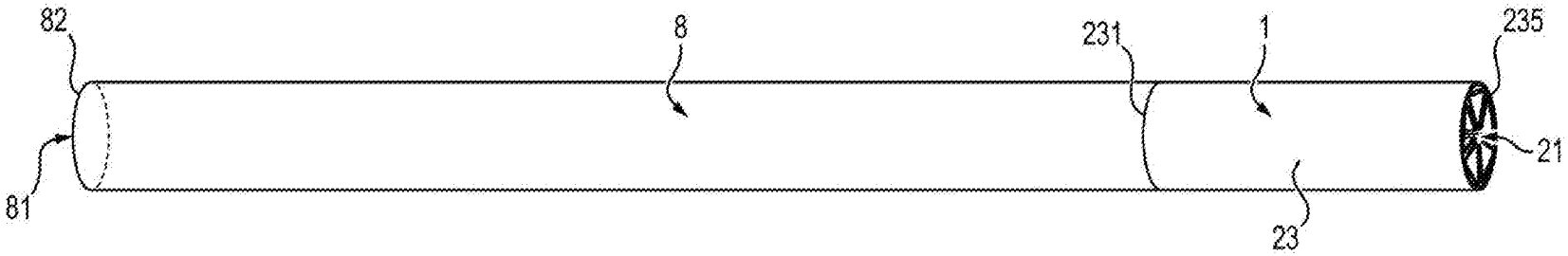
[Fig. 9]

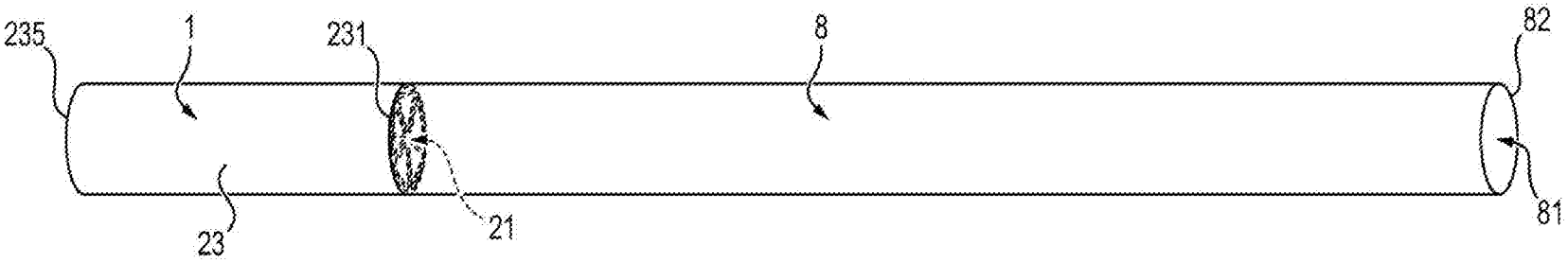
[Fig. 10]

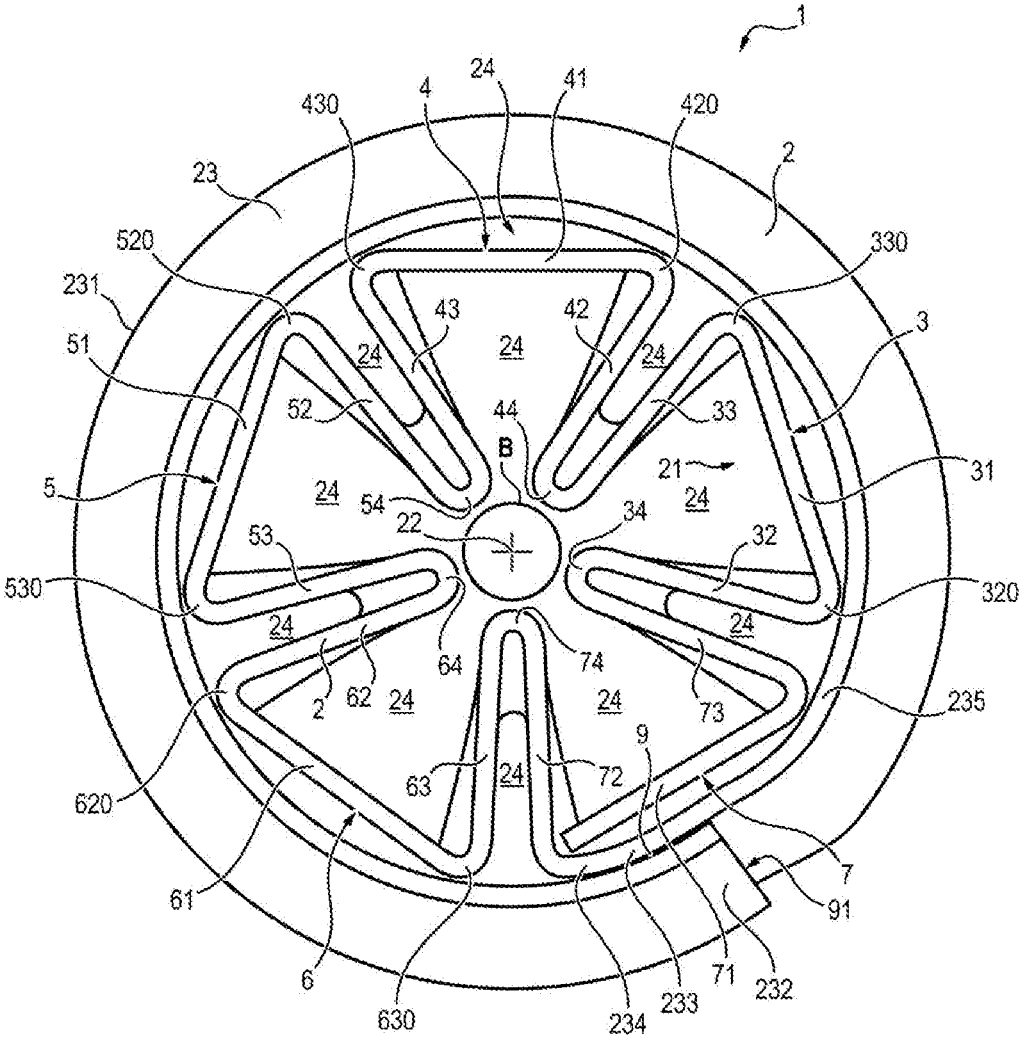
[Fig. 11]

CARDBOARD FILTER FOR CIGARETTES, CIGARETTE AND MANUFACTURING METHOD THEREOF

CROSS-REFERENCE TO RELATED APPLICATIONS

This application claims priority from French application number 1901882, filed Feb. 25, 2019, the disclosure of which is hereby incorporated herein by reference.

The present invention relates to the field of articles for smokers and particularly cigarettes.

More specifically, the present invention relates to the field of filters for cigarettes, in particular filters for roll-on-your-own cigarettes or roll-up cigarettes.

There are known many types of cigarette filters or manufactured tubes which are asymmetrical (cones) or not, intended for smokers.

A first type of filter is composed of cylindrical blocks of foam or cellulose. These filters for cigarettes allow filtering certain substances contained in tobacco, and thus reducing the impact of tar and nicotine, as well as softening the smoke.

There is also known a second type of coarser filters for cigarettes, made by winding a cardboard strip, which are those described below and those concerned with the invention.

These filters are generally called "toncar" which corresponds to the reversal of "carton", or "tips".

There are many types of these cardboard filters provided in the form of a book or a roll, which are printed or not, delivered flat or not, and which the user winds when forming a cigarette.

There are also pre-wound filters ready for use, as there are pre-manufactured tubes, which are asymmetrical or not, comprising this same type of pre-wound filters.

The use of cardboard filters allows the user of winding paper to position a filter at the end of the cigarette in order to prevent tobacco from getting out of the cigarette and going into the mouth. It also allows smoking all the tobacco in the cigarette without being burned.

An example of these cardboard filters is known from document FR-A-3 057 441.

One of the disadvantages of these known filters is the low rigidity of the filter.

Another disadvantage of these known filters is the irregular shape of the gas passage channels present between the folds of the cardboard strip in the filter, particularly when the filter is wound by the smoker.

Another disadvantage is that filters of the prior art often leave too large gas passage channels between the folds of the cardboard strip in the filter, increasing the risk of tobacco crossing.

The invention aims at obtaining a filter and/or a cigarette provided with this filter, which overcome the disadvantages of filters of the state of the art.

To this end, a first subject matter of the invention is a cardboard filter for cigarettes, formed by folding, winding and gluing a strip of cardboard, characterized in that the cardboard strip is folded to form a central portion having a series of lobes angularly equally distributed around a central axis of the filter and a peripheral portion surrounding the central portion, the lobes and the peripheral portion delimiting gas passage channels around the central axis.

Thanks to the invention, the filter has better filtering capacity thanks to the regularity of the sections of the gas passage channels between the folds of the cardboard strip in the filter. This regularity of the channels allows having channels of smaller sections and more numerous channels. The lobes formed by folds form numerous inner support points, distributed regularly around the axis, for the peripheral portion, which improves the rigidity. The geometry of the filter is more regular and improves the filtration, the rigidity of the filter and its aesthetics. The folding, winding and gluing of the cardboard strip to manufacture the filter are carried out by a manufacturing method in an automated manner by a machine. The large number of folded segments of the cardboard strip in the central portion and their length contribute to better retention of the tobacco shreds and the smoking ingredients.

According to one embodiment of the invention, the gas passage channels are angularly equally distributed around the central axis of the filter.

According to one embodiment of the invention, the lobes have at least one outer portion being in contact against the peripheral portion.

According to one embodiment of the invention, at least one of the lobes comprises:

- at least one outer segment, which is located facing the peripheral portion,
- a first inner segment, which extends between a first outer end fold of the outer segment and a central area of the filter comprising the central axis,
- a second inner segment, which extends between a second outer end fold of the outer segment and the central area of the filter.

According to one embodiment of the invention, the filter comprises at least one first lobe and one second lobe, which is adjacent to the first lobe, the second inner segment of the first lobe being linked to the first inner segment of the second lobe by an inner end fold of them.

According to one embodiment of the invention, one of the lobes comprises:

- at least one outer segment located facing the peripheral portion,
- a first inner segment that is not folded relative to the outer segment,
- a second inner segment which extends between a second outer end fold of the outer segment and the central area of the filter,
- another area of the peripheral portion, located facing the outer segment, being connected to the first inner segment by a first outer fold.

According to one embodiment of the invention, the peripheral portion is of a frustoconical shape around the central axis.

According to another embodiment of the invention, the peripheral portion is of circular cylindrical shape around the central axis.

According to one embodiment of the invention, the lobes delimit therebetween a central space containing the central axis.

According to one embodiment of the invention, at least three lobes are provided.

According to one embodiment of the invention, five lobes are provided.

According to one embodiment of the invention, a sheet delimiting an axial tube intended to contain tobacco is glued on an axial end of the peripheral portion in the continuation of the peripheral portion.

A second subject matter of the invention is a cigarette characterized in that it comprises a cardboard filter as described above.

A third subject matter of the invention is a method for manufacturing the filter as described above, a filter in which the lobes delimit therebetween a central space containing the central axis, characterized in that the method comprises a step of immobilizing the filter, in which the filter is threaded by a machine through its central space around a pin to hold the filter, then a step of fixing a sheet delimiting an axial tube intended to contain tobacco, in which the sheet is glued by the machine in the continuation of the peripheral portion on an axial end of the peripheral portion of the filter held on the pin, then a step of separating the filter from the pin.

The invention will be better understood upon reading the description which follows, given only by way of non-limiting example with reference to the figures of the appended drawings, in which:

FIG. 1 schematically shows a perspective view from the front of the filter according to a first embodiment according to the invention, FIG. 2 schematically shows a perspective view from the rear of the filter according to the first embodiment according to the invention, FIG. 3 schematically shows a side perspective view of the filter according to the first embodiment according to the invention, FIG. 4 schematically shows a side view of the filter according to the first embodiment according to the invention, FIG. 5 schematically shows a side perspective view of the filter equipped with a tube having to contain tobacco according to the first embodiment according to the invention, FIG. 6 schematically shows a side perspective view of the filter equipped with a tube having to contain tobacco according to the first embodiment according to the invention, FIG. 7 schematically shows a top view of the filter in the unfolded state according to the first embodiment according to the invention, FIG. 8 schematically shows a side perspective view of the filter according to a second embodiment according to the invention, FIG. 9 schematically shows a side perspective view of the filter equipped with a tube having to contain tobacco according to the second embodiment according to the invention, FIG. 10 schematically shows a side perspective view of the filter equipped with a tube having to contain tobacco according to the second embodiment according to the invention, FIG. 11 schematically shows a perspective view from the rear of the filter according to the first embodiment according to the invention, which is threaded on a pin.

In FIGS. 1 to 11, the filter 1 comprises a cardboard strip 2, such as for example that shown in FIG. 7, which was folded, then wound, then glued during an automated manufacturing method on a series manufacturing machine, to obtain the three-dimensional shape of the filter 1, such as for example that shown in FIGS. 1 to 6 and 8 to 11. This filter 1 is therefore made of cardboard and is intended to form a filter 1 or a mouthpiece 1 for cigarettes, that is to say the end portion of the cigarette, to be placed in the mouth of the smoker.

The filter 1 comprises, in the folded state of the cardboard strip 2, a central portion 21 having lobes angularly equally distributed around a central axis 22 of the filter 2. Three lobes or more than three lobes can be provided. For example, in the embodiment shown in the figures, five lobes 3, 4, 5, 6, 7 are provided. The lobes are generally designated below by the reference signs 3, 4, 5, 6, 7, but of course a number of lobes other than five can be provided. The lobes 3, 4, 5, 6, 7 are for example in the shape of a flower centered on the axis 22 and surrounded by the peripheral portion, the petals of the flower being formed by the lobes. Each lobe can be formed of a variable number of segments which folded one after the other and/or superimposed, for example from 3 to 10 segments. Each segment can be flat, such as for example in the embodiments shown in the figures. The lobes may have the same shape and/or identical segments, such as for example for the lobes 3, 4, 5, 6 in the embodiments shown in the figures. An embodiment is described below in more detail where each lobe 3, 4, 5, 6, 7 is of a generally triangular shape and where each lobe 3, 4, 5, 6 is formed of three segments folded one after the other. The advantage of this shape is also industrial. This design allows manufacturing the cardboard filter in a single operation from a cardboard reel, unwound and cut, for example according to FIG. 7. The advantage of this unwinding and cutting operation is to automate the manufacture of the filters on a machine.

The filter 1 comprises, in the folded and wound state of the cardboard strip 2, a peripheral portion 23 surrounding the central portion 21 and therefore surrounding the lobes. The lobes and the peripheral portion 23 are therefore formed by a single continuous cardboard strip 2.

The central portion 21 comprises gas passage channels 24. These gas passage channels 24 are delimited by the lobes 3, 4, 5, 6, 7 and by the peripheral portion 23 and are therefore located around the central axis 22.

Thus, due to the regular structure of the lobes 3, 4, 5, 6, 7 of the central portion 21, the gas passage channels 24 are distributed regularly around the central axis 22 of the filter 2. The gas passage channels 24 located in the lobes 3, 4, 5, 6, 7 are thus substantially identical and have a substantially identical section. These gas passage channels 24 located in the lobes 3, 4, 5, 6, 7 are those of the widest section compared to the gas passage channels 24 located outside the lobes 3, 4, 5, 6, 7 between the latter and the peripheral portion 23. The number of channels 24 is twice as large as the M-folding known from document FR-A-3 057 441. The gas passage channels 24 inside the lobes 3, 4, 5, 6, 7 can thus have a section close to half that of the channels of the M-filter known from document FR-A-3 057 441.

The filter 1 thus ensures a uniform distribution of the stresses of each fold of the cardboard strip. This homogeneity and the large number of folds allow a regular winding of the peripheral area and provide a great rigidity to the three-dimensional filter and a regular bearing of each lobe against the peripheral area 23. The lobes ensure a reinforced support to the peripheral portion 23.

The smoker thus has a pre-manufactured three-dimensional filter 1. The smoker can himself glue a sheet 8 delimiting an axial tube 81 intended to contain tobacco on an axial end 231 of the peripheral portion 23 in the continuation of the peripheral portion 23, as shown in FIGS. 5, 6, 9 and 10. The invention also provides a pre-manufactured assembly, consisting of the filter 1 and the sheet 8 glued thereon, as will be described below.

According to an embodiment shown in the figures, the cardboard strip 2 has at least one area 9 for gluing on itself. For example, the gluing area 9 is located on the peripheral portion 23. For example, the outer end area 232 of the cardboard strip 2 located in the peripheral portion 23 is glued on another underlying area 233 of this peripheral portion 23. This gluing area 9 extends for example according to a line 91 along the axis 22, this line 91 being for example rectilinear.

According to an embodiment shown in the figures, each lobe 3, 4, 5, 6, 7 comprises at least one outer portion or at least one outer segment 31, 41, 51, 61, 71 having one or more contact point(s) or contact edge(s) against the peripheral portion 23. Each outer portion or outer segment 31, 41, 51, 61, 71 may be formed of a segment or of several segments folded one after the other. For example, in the figures, each lobe 3, 4, 5, 6, 7 is in contact with the peripheral portion 23 by the first outer end folds 320, 420, 520, 620, 720 of the outer segment 31, 41, 51, 61, 71 and by the second outer end folds 330, 430, 530, 630, 730 of the outer segment 31, 41, 51, 61, 71. The outer segment 31, 41, 51, 61, 71 thus serves as a support to the peripheral portion 23.

According to an embodiment shown in the figures, each lobe 3, 4, 5, 6 comprises respectively:

an outer segment 31, 41, 51, 61, which is located facing the peripheral portion 23, a first inner segment 32, 42, 52, 62, which comprises a first outer end fold 320, 420, 520, 620 connecting it to the outer segment 31, 41, 51, 61 and which extends between this first outer end fold 320, 420, 520, 620 and a central area 220 of the filter 2 comprising the central axis 22, a second inner segment 33, 43, 53, 63, which comprises a second outer end fold 330, 430, 530, 630 connecting it to the outer segment 31, 41, 51, 61 and which extends between this second outer end fold 330, 430, 530, 630 and the central area 220 of the filter 2.

According to an embodiment shown in the figures, one of the lobes, such as for example the lobe 7 in the figures, comprises:

an outer segment 71 located facing the peripheral portion 23, a first inner segment 72 that is not folded relative to the outer segment 71, a second inner segment 73, which extends between a second outer end fold 730 of the outer segment 71 and the central area 220 of the filter 2. Another area 234 of the peripheral portion 23, located facing the outer segment 71, is connected to the first inner segment 72 by a first outer fold 720. The lobes are thus looped back on themselves, to form from the first outer fold 720 of the lobe 7 the peripheral portion 23. The gluing area 9 can be located above the outer segment 71, that is to say that the underlying gluing area 233 may be the other area 234. For example, the second inner segment 73 can be at the inner end of the cardboard strip 2. Of course, two overlapping inner segments could be provided, in addition to the outer segment 71. The inner segments 32, 42, 52, 62, 72, 33, 43, 53, 63, 73 extend from the central area 200 to the peripheral portion 23 or generally radially relative to the central axis 22.

According to an embodiment shown in the figures, for at least one first lobe 3, 4, 5, 6 and one second lobe 4, 5, 6, 7, which is respectively contiguous to the first lobe 3, 4, 5, 6, the second inner segment 33, 43, 53, 63 of the first lobe 3, 4, 5, 6 is linked to the first inner segment 42, 52, 62, 72 of the second lobe 4, 5, 6, 7 by an inner end fold 44, 54, 64, 74 thereof. According to an embodiment shown in the figures, the second inner segment 73 of the lobe 7 is linked to the first inner segment 32 of the second lobe 3 by an inner end fold 34 thereof.

According to one embodiment, the peripheral portion 23 of the filter 1 can be of a substantially frustoconical shape around the central axis 22, as shown for example in FIGS. 1, 2, 3, 4, 5, 6, 7 and 11.

According to another embodiment, the peripheral portion 23 can be of a substantially cylindrical shape, for example substantially circular cylindrical, around the central axis 22, as shown for example in FIGS. 8, 9 and 10.

According to one embodiment, a sheet 8 delimiting an axial tube 81 intended to contain tobacco is glued on the outer surface of the axial end 231 of the peripheral portion 23 in the continuation of the peripheral portion 23, as shown in FIGS. 5, 6, 9 and 10. Furthermore, the sheet 8 is glued on itself at its longitudinal ends along the axis 22. This gluing is for example performed in an automated manner on a series machine, for example using the manufacturing method described below. A cigarette can thus comprise this sheet 1 fixed to the filter 1. The smoker having obtained the pre-manufactured assembly consisting of the filter 1 and the sheet 8 glued to the filter 1 can then introduce tobacco into the axial tube 81 through its end opening 82 distant from the filter 1. For example, in FIGS. 5 and 6, the filter 1, the sheet 8 and the axial tube 81 are substantially frustoconical around the axis 22 (the sheet 8 being glued to the axial end 231 of the peripheral portion 23, which is the widest compared to the other axial end 235 of the filter 1). For example, in FIGS. 9 and 10, the filter 1, the sheet 8 and the axial tube 81 are substantially cylindrical, for example substantially circular cylindrical, around the axis 22.

According to one embodiment, the lobes 3, 4, 5, 6, 7 delimit therebetween a central space 220 containing the central axis 22. For example, this central space 220 (which is also a gas passage channel) is located between the inner folds 34, 44, 54, 64, 74 of the inner segments 32, 42, 52, 62, 72, 33, 43, 53, 63, 73. This central space 220 allows introducing a pin B for holding the filter for fixing thereon the sheet 8 delimiting the axial tube 81 intended to contain tobacco, as shown in FIGS. 5, 6, 9, 10 and 11.

An automated method for manufacturing the assembly consisting of the pre-manufactured filter 1 and of the sheet 8 glued to the filter 1 may comprise the steps described below. During a step of immobilizing the filter, the filter 1 is threaded by a machine through its central space 220 around a pin B to hold the filter 1. Then, during a step of fixing the sheet 8, the sheet 8 is glued by the machine in the continuation of the peripheral portion 23 on the axial end 231 of the peripheral portion 23 of the filter 1 held on the pin B. Then, during a step of separating the filter 1 from the pin B, the pin B is removed from the filter 1.

Of course, the above embodiments, characteristics, possibilities and examples can be combined with one another or be selected independently from one another.

The invention claimed is:

1. A cardboard filter for cigarettes, comprising a cardboard strip, wherein the cardboard strip is folded to form a central portion having a series of lobes angularly equally distributed around a central axis of the cardboard filter and a peripheral portion surrounding the central portion, the lobes and the peripheral portion delimiting gas passage channels around the central axis, wherein an outer end area of the cardboard strip located in the peripheral portion is glued on another underlying area of the peripheral portion, wherein the lobes comprise at least one first lobe and at least one second lobe, which each comprise:

at least one outer segment, which is located facing the peripheral portion, a first inner segment, which extends between a first outer end fold and a first inner end fold, a second inner segment, which extends between a second outer end fold and a second inner end fold, wherein the at least one outer segment extends between the first outer end fold and the second outer end fold, wherein the first outer end fold, the second outer end fold, the first inner end fold and the second inner end fold are present in the central portion, wherein the first inner end folds and the second inner end folds delimit therebetween a central space containing the central axis in the central portion, wherein one of the lobes, other than the at least one first lobe and than the at least one second lobe, comprises:

at least one other outer segment located facing the peripheral portion, a first other inner segment that is not folded relative to the at least one other outer segment, a second other inner segment which extends between a second other outer end fold of the at least one other outer segment and the second inner end fold of one of the at least one first lobe and of the at least one second lobe, another area of the peripheral portion, located facing the at least one other outer segment, being connected to the first inner other segment by a first other outer fold, wherein the at least one other outer segment extends to a distance from the second other outer end fold of the at least one other outer segment.

2. The cardboard filter according to claim 1, wherein the gas passage channels are angularly equally distributed around the central axis of the cardboard filter.

3. The cardboard filter according to claim 1, wherein the lobes have at least one outer portion being in contact against the peripheral portion.

4. The cardboard filter according to claim 1, wherein the at least one second lobe is adjacent to the at least one first lobe, the second inner segment of the at least one first lobe being linked to the first inner segment of the at least one second lobe by the first inner end fold of the at least one second lobe.

5. The cardboard filter according to claim 1, wherein the peripheral portion is of a frustoconical shape around the central axis.

6. The cardboard filter according to claim 1, wherein the peripheral portion is of circular cylindrical shape around the central axis.

7. The cardboard filter according to claim 1, having at least three lobes.

8. The cardboard filter according to claim 1, having five lobes.

9. The cardboard filter according to claim 1, wherein a sheet delimiting an axial tube intended to contain tobacco is glued on an axial end of the peripheral portion in a continuation of the peripheral portion.

10. A cigarette wherein it comprises a cardboard filter according to claim 1.

* * * * *